United States Patent [19]

Casey

[11] Patent Number: 4,646,641

[45] Date of Patent: Mar. 3, 1987

[54] EXPLOSIVE DEVICE AND METHOD OF USE THEREFOR

[75] Inventor: Kenneth Casey, Willowdale, Canada

[73] Assignee: Du Pont Canada Inc., Mississauga, Canada

[21] Appl. No.: 794,555

[22] Filed: Nov. 4, 1985

[30] Foreign Application Priority Data

Nov. 23, 1984 [GB] United Kingdom ..... 8429691

[51] Int. Cl.[4] ..... F42B 1/02

[52] U.S. Cl. ..... 102/306; 102/307; 102/310

[58] Field of Search ..... 102/306, 307, 310

[56] References Cited

U.S. PATENT DOCUMENTS

| | | | |
|---|---|---|---|
| 3,165,057 | 1/1965 | Armstrong | 102/307 |
| 3,242,987 | 3/1966 | Lebourg | 102/306 X |
| 3,444,811 | 5/1969 | Abbott et al. | 102/307 |
| 3,765,333 | 10/1973 | Reed et al. | 102/307 X |
| 4,297,946 | 11/1981 | Paton et al. | 102/307 |
| 4,418,622 | 12/1983 | Foster et al. | 102/307 |
| 4,474,113 | 10/1984 | Kyro et al. | 102/306 |

FOREIGN PATENT DOCUMENTS

| | | | |
|---|---|---|---|
| 2059551 | 4/1981 | United Kingdom | 102/306 |

*Primary Examiner*—Peter A. Nelson

[57] ABSTRACT

An explosive device is disclosed, which is particularly suitable for high energy applications, e.g., priming blasting explosives, cutting cables and for secondary blasting. The device comprises an explosive material having an indentation upon a surface thereof. The indentation which has a mouth, is substantially symmetrical about an axis perpendicular to the mouth. The cross-sectional area of the mouth is at least as great as any other cross-sectional area, normal to the axis, within the indentation. The thickness of explosive surrounding the mouth is greater than the critical diameter of the explosive.

14 Claims, 13 Drawing Figures

EXPLOSIVE DEVICE AND METHOD OF USE THEREFOR

The present invention is directed to an explosive device, the energy from which is directionally concentrated, and methods for using such device.

In underground excavations, roof support for underground cavities e.g. tunnels, may be provided using rock bolts inserted into boreholes in the roof, or using cables inserted into boreholes extending between the roof and an upper floor. With the cable method, cables are inserted into boreholes and each cable is "capped" at either end, at the rock face where the cable emerges from the rock. Any excess length of cable is then cut off and discarded. The cables usually have very high tensile strength and tend to be extremely difficult to cut using mechanical methods. Cutting with high temperature torches is also slow and hazardous. It has been suggested that the cables may be cut with explosives. However, even several wraps of 400 grain detonating cord, have proven ineffective in severing a typical 7-strand 16 mm diameter cable.

In blasting operations, after detonation of the primary blast, unwieldy blocks or boulders must be broken into more manageable pieces. This is often accomplished by secondary blasting, either by drilling the block or boulder and placing an explosive in the drill-hole, or by "mud capping" wherein explosives are placed directly on an external surface of the block or boulder.

A trend in the explosives industry is to strive to develop inexpensive blasting explosives, particularly for use as "top loads" or for use in relatively easy breaking rock. Often, however, an unwanted consequence of developing such inexpensive blasting explosives is that they are difficult to initiate. Indeed some may require a 5 lb. explosive primer for initiation rather than the more common 1 lb. explosive primer. This is most undesirable as the larger primer markedly adds to the cost of explosives per borehole. A more efficient explosives primer or method of priming would therefore be desireable.

Explosive primers, capable of initiating blasting explosives to detonation, are known. Most commercial primers are cylindrical in shape with a coaxial detonating cord through-tunnel and/or a capwell. The through-tunnel has an internal diameter (ID) e.g. 7.24 mm, slightly larger than the external diameter of commercial detonating cords e.g. Scufflex* detonating cord (5.97 mm OD). The capwell has an internal diameter slightly larger than the external diameter (OD) of commercial blasting caps (7.49 mm OD). The purpose of the through-tunnel and capwell is to permit a detonating cord or blasting cap to be placed in close proximity to a portion of the primer which is sensitive to initiation by the detonating cord or blasting cap. Such portion is sufficiently powerful, upon initiation, to initiate the rest of the primer to detonation. The primer is of such a size that its detonation is sufficient to initiate a surrounding blasting explosive to detonation.

* denotes trade mark

Explosive primers of the type described above are disclosed in Canadian Pat. No. 759 252 to Cook et al., which issued 1967 May 23, U.S. Pat. No. 2 709 407 to A. J. Lowe, which issued 1955 May 31, Canadian Pat. No. 934 244 to G. Towell, which issued 1973 Sep. 25 and Canadian Pat. No. 973 756 to G. L. Griffith, which issued 1975 Sep. 02. A tubular PETN-based explosive, having an internal diameter of from about 5.8 to 7.9 mm and an external diameter of from about 11.1 to 16.1 mm, is available under the trade mark DETAPRIME.

In addition to the aforementioned uses for explosives, explosives are used in the seismic exploration industry in order to provide a source of shock waves. Commonly, boreholes are drilled into the earth's surface and explosives are placed at the bottom of the borehole. Such explosives are then detonated in order to provide a shock impulse to the surrounding rock. Another method which has not found much favour is to detonate a mass of explosive on the surface of the earth. In order to increase the energy transmitted from the explosive to the rock at the earth's surface, so-called shaped charges have been experimented with, but with little success.

It has now been discovered that the above operations may be carried out more effectively when certain configurations of explosives are used.

The present invention provides hitherto unrecognized applications of the so-called Munroe effect.

About 1888 C. E. Munroe discovered that the greatest effect of an explosive device is produced at a point where explosive waves emanating from different directions meet and reinforce each other. About 1910 E. Neumann discovered that blocks of TNT having conical indentations therein blew holes through wrought iron plates, whereas solid blocks of greater weight only bent or dented them. The discoveries of Munroe and Neumann led to the development of so-called shaped charges, which have lined conical indentations therein and have 'stand-off' devices as described hereinafter. Shaped charges are used for jet tapping for steel furnaces and metal piercing, e.g. in military applications. Experiments have also been conducted by the U.S. Bureau of Mines wherein shaped charges have been used to obtain maximun penetration in rock. In order to obtain maximum penetration it has been found necessary to line the conical indentations with metal liners, e.g. copper liners, and to leave an air gap between the shaped charge and the material e.g. steel furnace plug which is to be pierced by the explosive force discharged from the shaped charge. The distance between the shaped charge and the material is often referred to as the stand-off distance and various devices have been used to obtain such a stand-off. In addition, it has been the practice to design shaped charges in such a manner that the diameter of the mouth of the shaped charge is substantially the same as the diameter of the explosive.

It has how been found that various types of shaped charge have much wider application if there is no stand off distance between the explosive and the substrate which is to be explosively affected and if the mouth of the cavity is surrounded by explosive material as described hereinafter.

Accordingly, the present invention provides an explosive device comprising a mass of explosive having an indentation upon a surface thereof, said indentation being in the form of a cavity in said explosive, said cavity having a mouth at said surface and said cavity being substantially symmetrical about an axis perpendicular to said mouth, the cross-sectional area of said mouth being about the same as or greater than any other cross-sectional area about said axis within said cavity, said mouth being surrounded by the explosive such that explosive surrounding the mouth has a thickness greater than the critical diameter of said explosive.

Preferably said explosive has means adapted to accomodate a blasting cap at a position distal to said mouth.

The shape of the cavity is preferably a right cone, a truncated right cone, a right cylinder, a hemisphere or a hemi-oblate spheroid.

The present invention also provides methods for cutting rods, cable and the like, for seismic prospecting, for secondary blasting and for priming blasting explosives. Such methods comprise placing the explosive device of the present invention, substantially in direct contact with the substrate which is to be explosively affected, with the mouth of the cavity being substantially in direct contact with the substrate.

Preferred explosive devices depend, to some extent, on the application to which the device is being put. The aforementioned methods are described hereinafter with reference to such preferred explosive devices.

The present invention will be described with reference to the drawings in which FIGS. 1 to 4 are cross-sectional views of explosive devices of the present invention:

With respect to elongate articles, e.g. severing rods, cable and the like, the preferred explosive device comprises a tubular explosive, open at one end, having an internal diameter of at least about the diameter of the rod, cable or the like which is to be severed, an internal length at least as long as said internal diameter, and a wall thickness of at least as great as the critical diameter of said explosive, said tubular explosive being adapted to be initiated to detonation at the end distal to said open end of said tubular explosive.

In a preferred embodiment the tubular explosive has means, at said open end, for maintaining the explosive in contact with the rod, cable or the like.

For such applications, the preferred explosive comprises PETN in a binder. The binder may be plastic or resinous. One such plastic explosive is sold under the trade mark DETAPRIME. The internal diameter of the tubular explosive must be at least as great as the diameter of the rod, cable or the like; otherwise the rod, cable or the like may not be severed.

It will be understood that the wall thickness of the portion of the primer surrounding the cavity must be at least the critical diameter of the high explosive. The term "critical diameter" is well known in the explosive art to mean the minimum diameter of a particular explosive composition at which the explosive will sustain detonation once initiated.

Figure 3:
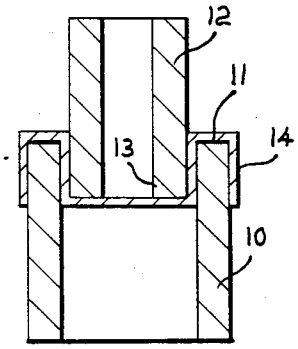
Figure 4:
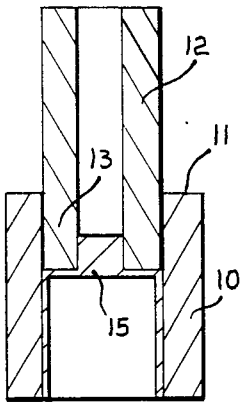
Figure 5:
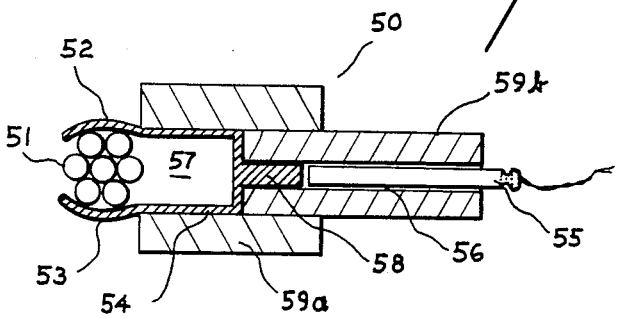
FIG. 5 is a cross-sectional view of an explosive device of the present invention attached to a cable.

FIGS. 1 to 4 show several embodiments of the tubular explosive and FIG. 5 shows a cross-section of an arrangement for cutting cable.

Figure 1:
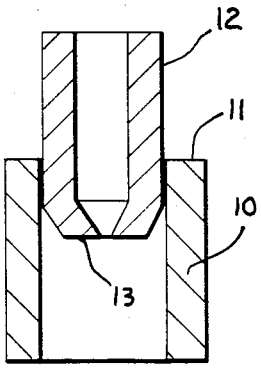

FIG. 1 shows two tubular explosives 10 and 12, one fitted inside the other. Tubular explosive 12 is push-fitted inside the tubular explosive 10 so that the distance between end 13 of tubular explosive 12 and the end 11 of tubular explosive 10 is at least as great as the internal diameter of tubular explosive 10. The internal diameter of tubular explosive 12 is sized to accept a blasting cap or other priming device. As shown in FIG. 1, end 13 is preferably capped or pinched to prevent the blasting cap from penetrating past end 13. The capped end is not neccessary but some means for correctly situating the blasting cap is preferred.

Figure 2:
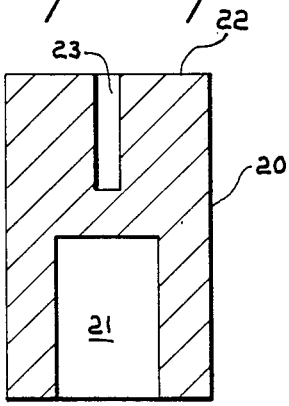

FIG. 2 shows a cylinder 20 of explosive having a coaxial cavity 21 therein. End 22, furthest from the cavity is adapted for coupling to a priming device, i.e. it has a capwell 23 therein.

FIGS. 3 and 4 show a tubular device similar to that shown in FIG. 1 except that the two tubes are held in juxtaposition by plastic holders 14 and 15 respectively.

FIG. 5 shows tubular explosive 50 held to cable 51 by a plastic device 52. Device 52 comprises snap-fit jaws 53 and canister-like holder 54 with external barbed teeth (not shown) and coaxial plug 58 attached to holder 54. Plug 58 may also have barbed teeth thereon (not shown). Tubular explosive **59*a* is push fitted onto canister 54 and tubular explosive 59*b* is push fitted into tubular explosive 59*a* and onto plug 58. The bore of explosive 59*b* serves as a capwell 56. Capwell 56 is distal to cavity 57**.

The barbed teeth serve to grip explosive **59*a*, 59*b* and prevent accidental movement of the explosive. In operation jaws 53 are snap fitted onto cable 51. Blasting cap 55 is inserted into capwell 56. It will be clear to one skilled in the art that if explosive 50 is not cap sensitive a primer larger than a blasting cap is required. Upon initiation of blasting cap 55, electrically or otherwise, explosive 50 is initiated. The explosive jet emanating longitudinally from cavity 57 is sufficient to shear cable 52 at a position directly in line with the longitudinal axis of tubular explosive 50**.

With respect to secondary blasting, an explosive device similar to that described above for cable cutting is preferred for use when blocks or boulders are drilled.

Figure 6:
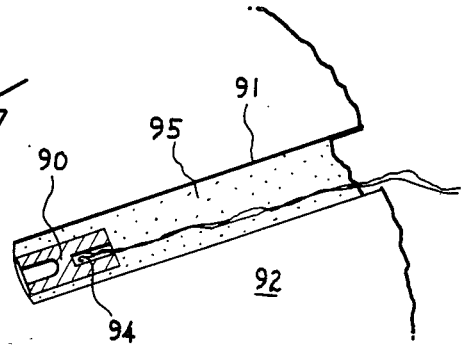
FIG. 6 is a cross-sectional view of an explosive device of the present invention in a borehole in a boulder.

FIG. 6 shows tubular explosive 90 inside borehole 91 which has been drilled about 0.3–0.5 m into the boulder 92. Tubular explosive 90, is positioned at the bottom of borehole 91. Tubular explosive 90 is primed with an electric blasting cap 94 having electric wires attached thereto. The borehole is preferably stemmed with stemming material 95. In use the blasting cap wires are connected to a blasting machine (not shown) and the blasting cap and tubular explosive are detonated thereby. Using this arrangement, it is not unusual to break 1 $m^3$ boulders with 9 g of tubular explosive.

Figure 7:
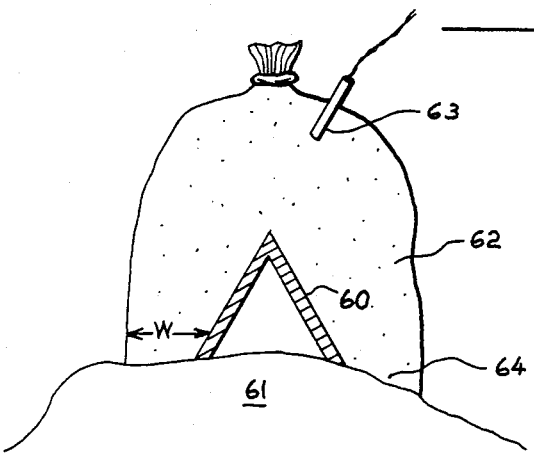
FIG. 7 is a cross-sectional view of an explosive device of the present invention on the exterior of a boulder.

When secondary blasting is accomplished by placing the explosive device directly on the block or boulder it is preferred that the explosive be of a consistency which permits the explosive to conform to the usually rough surface of the block or boulder. Suitable explosives are those known as water-gels, and emulsions; other "plastic" explosives may also be used. This is not to suggest that less pliant explosives may not be used; indeed cast TNT or other solid explosives may also be effective. When "conformable" explosives are used it is often convenient for the explosive device of the present invention to be supplied as a kit which comprises a cavity shaping device e.g. a cone made of paper, polyethylene or other plastic material, and the explosive. The explosive may be supplied, conveniently, in fat sausage-like packages. As shown in FIG. 7, in use, first the cavity shaping device 60 is placed upon the block or boulder 61. Then the sausage-like package is cut transversely so that these are two portions of explosive, each with an exposed face of explosive. One portion 62 is then slapped, with some degree of care and precision, onto the cavity shaping device, thus driving the device into the explosive. The explosive surrounding the mouth of the device is in contact with the boulder. The second portion of explosive (not shown) may be used for another device of the present invention. It is important that the portion of explosive 64 surrounding the mouth of cavity shaping device 60 be of a width W which is at least the critical diameter of explosive 62. The explosive 62 is then primed with a blasting cap 63 at a position distal to the mouth of the cavity shaping device. Mud-capping is not necessary.

Figure 8:
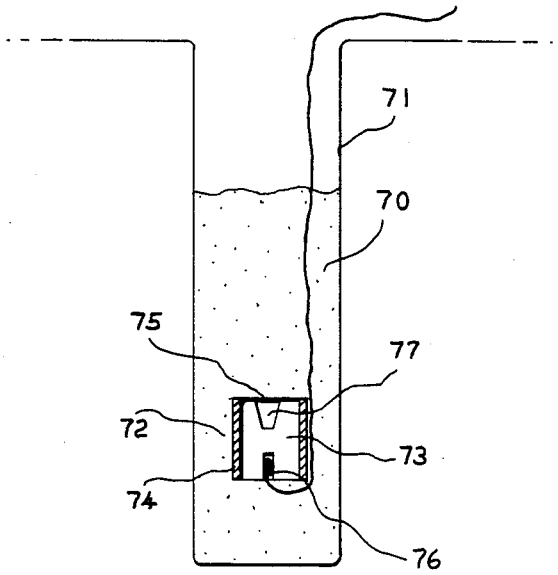
FIG. 8 is a cross-sectional view of a primer of the present invention embedded in a blasting explosive in a borehole.

With respect to primary blasting explosives, reference is made to FIG. 8, which shows a blasting explosive 70 in a borehole 71. The blasting explosive 70 is primed with explosive device 72 which comprises, explosive 73 having cavity 77, canister 74 and cavity cap 75. Explosive 73 also has a capwell 76. Tubular explosive 73 may be made from pentolite, cast TNT, Composition B, cap sensitive slurry explosive or other explosive. Pentolite, TNT or Compositon B are preferred. Tubular explosive 73 is substantially more effective as a primer than conventional cylindrical explosives.

A convenient method for priming a non-cap sensitive blasting explosive comprises placing in the blasting explosive an explosive primer comprising a cylindrical charge of high explosive, said primer having one end with a longitudinal substantially cylindrical cavity therein, the cross sectional area of said cavity having a value of $(\pi D^2)/4$ wherein D is at least 50% of the critical diameter of the blasting explosive, the internal length of each cavity being at least D, and said cavity being adapted to prevent ingress of said blasting explosive, said primer being sensitive to initiation by a blasting cap or detonating cord and being primed with a blasting cap or detonating cord at a position at the end of the primer distal to said cavity.

The term "high explosive" is used to differentiate said explosive from the term "blasting explosive" and is not intended to be limited by definitions made by governmental or other agencies, which definitions are primarily made for the purpose of transportation and storage classifications. The term high explosive as used herein includes those high explosives as defined by said agencies, e.g. TNT, but also includes explosives such as ammonal, slurry explosives and emulsion explosives.

In one embodiment, the primer has a single cavity.

In a preferred embodiment the high explosive is selected from TNT, PETN in a matrix, Composition B, RDX and mixtures thereof.

In another embodiment the outside diameter of the primer is from about 50 mm to 250 mm.

In a further embodiment, the primer has a coaxial through-hole adapted to accept a detonating cord.

It is to be understood that a cavity having a cross-sectional shape other than circular may be used. A circular cross-sectional shape is much preferred for reasons of ease of manufacture of the primer. The depth of the cavity in the explosive device preferably should be at least as great as the internal diameter of the cavity. Where the cross-section of the cavity is not circular, the terms diameter and average diameter mean the arithmetic mean diameter, which may be calculated mathematically by known methods.

For some applications, and for reasons of economy, the cavity may extend all the way through the explosive device i.e. the explosive device is tubular. However, means for preventing ingress of blasting explosive into the cavity and means for initiating the explosive device must be provided.

With respect to the means for preventing ingress of blasting explosive into the cavity, when the cavity has a small diameter and the blasting explosive does not flow easily, the cavity may merely be an open hole, much in the manner of through-holes and capwells in conventional primers. However, if the cavity has a large diameter or the blasting explosive is relatively free flowing, a plastic membrane or cap may be required across the entrance to the cavity.

Figure 9:
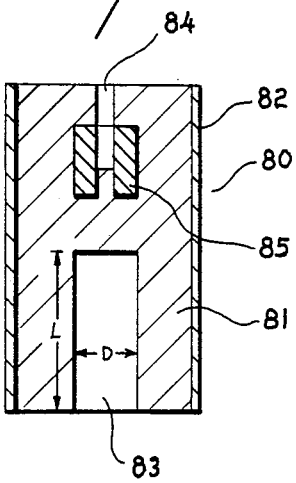
FIGS. 9, 10, 10A and 11 are cross-sectional views of primers of the present invention.
Figure 10:
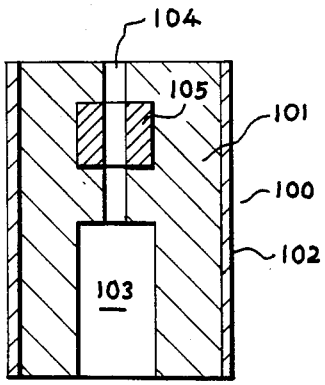
Figure 10A:
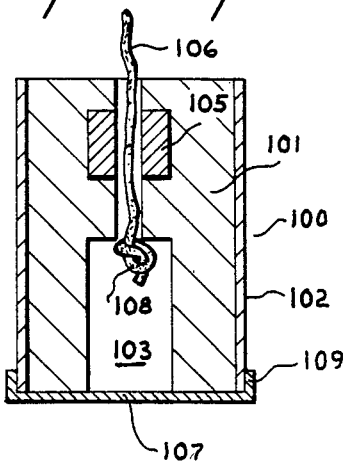

In the drawings FIG. 9 shows a cross-section of a primer of the present invention, with a capwell; FIG. 10 shows a cross-section of a primer of the present invention with a through-tunnel; FIG. 10A shows a cross-section of the primer of FIG. 10 with a cavity closure cap, and with detonating cord.

In FIG. 9, high explosive 81 is contained within tubular sleeve 82. Sleeve 82 may be cardboard or plastic. Cavity 83, at one end of primer 80, has an internal diameter D and a length L as shown. Length L is preferably at least as great as diameter D. At the end of primer 80 opposite to cavity 83 is capwell 84. Surrounding the inner end of capwell 84 is a cap sensitive booster 85 which, when detonated, has sufficient power to initiate high explosive 81 to detonation. Booster 85 may be omitted if high explosive 81 is cap sensitive e.g. pentolite.

In FIG. 10, primer 100 is similar to primer 80 of FIG. 9, except that capwell 84 has been replaced by through-tunnel 104. High explosives 81 and 101, sleeves 82 and 102, cavities 83 and 103, boosters 85 and 105 correspond to one another.

FIG. 10A shows primer 100 of FIG. 10, threaded onto detonating cord 106 and having end cap 107. Detonating cord 106 has a knot 108 at one end. In preparation for inserting primer 100 into a blasting explosive (not shown), detonating cord 106 is threaded through through-hole 104. The end of detonating cord 106 which protrudes through cavity 103 is knotted at knot 108 and detonating cord 106 is withdrawn through through-hole 104 until knot 108 nestles against the blind end of cavity 103. End cap 107 is then snap fitted over the cavity end of primer 100. Rim 109 of end cap 107 and sleeve 102 have cooperating means (not shown) to prevent end cap 107 from being dislodged easily from primer 100. End cap 107, which may be made of plastic, is intended to prevent blasting explosive from entering cavity 103, when primer 100 is inserted into said blasting explosive. End cap 107 may be omitted if the blasting explosive is sufficiently "stiff" so that it would not enter cavity 103.

A primer may also be made from two tubular explosives as shown in FIG. 1. If it is desired to initiate the primer with a detonating cord, however, the inner tubular explosive must not, of course, be capped or pinched.

Figure 11:
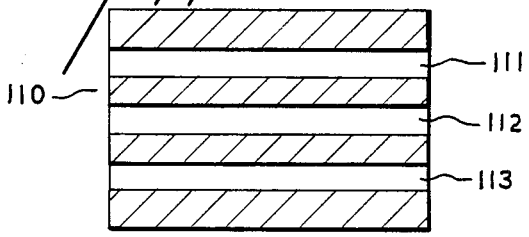

FIG. 11 shows primer 110, which has several closely spaced through-holes 111, 112 and 113. This is about equivalent in power to a primer having a single cavity of the same cross-sectional area as the total cross-sectional area of all the through-holes.

The primer 100 may be conveniently made by placing sleeve 102 on a horizontal board, such that sleeve 102 sits coaxially about a cavity-plus-through-hole shaped pin which protrudes from the board. Booster 105 is placed about the through-hole portion of the pin. Conveniently a molten TNT and TNT prill mixture is poured into sleeve 102 to the brim thereof and the TNT mixture is allowed to cool and solidify. Primer 100 may then be removed from the pin. Sleeve 102 may have an annular ridge on its outer surface, which ridge would act as a means for cooperating with a like ridge or furrow on the inner surface of rim 109 of end cap 107.

The primers of the present invention may be used in the same manner as conventional primers, for priming blasting explosives. For example in large diameter boreholes, slurry blasting explosive may be pumped into the toe of a borehole and a primer of the present invention, with the appropriate priming device (blasting cap or detonating cord) inserted therein, lowered into the borehole until it rests on the slurry explosive. More slurry explosive is then pumped on top of the primer. Instead of slurry blasting explosive, emulsion explosives, dry blasting agents e.g. ANFO, aluminized ANFO, or other blasting explosives may be used, alone or in combination as is known in the art.

With respect to seismic prospecting any of the constructions of explosive device of the present invention, described heretofore, may be used when placed on the earth's surface. It will be understood, however that the mass of the explosive and the size of the cavity will depend upon the nature of the overburden and/or the underlying rock strata.

The abbreviations used herein for various explosives are well known to those skilled in the art, but are explained hereinafter, for convenience:

| | |
|---|---|
| TNT | trinitrotoluene |
| PETN | pentaerithrytoltetranitrate |
| RDX | cyclonite |
| Composition B | RDX/TNT mixture |
| Pentolite | PETN/TNT mixture |
| ANFO | ammonium nitrate/fuel oil mixture |
| Ammonal | ammonium nitrate/aluminum or ammonium nitrate/aluminum/-TNT mixtures. |

The invention is illustrated further by reference to the following examples.

EXAMPLE I

A number of explosive devices were prepared from Detaprime P and Detaprime H tubular explosives. The cross-sectional dimensions of the Detaprime P explosive was 7.37 mm internal diameter (ID), 19.05 mm external diameter (OD) and corresponding dimensions for Detaprime H was 19.05 (ID) and 31.75 mm (OD). Four types of explosive devices were made by push-fitting the Detaprime P explosive inside the Detaprime H explosive.

TABLE 1

| | (see FIG. 12) Lengths (mm) | | | |
|---|---|---|---|---|
| Explosive Device | H | P | O | C |
| Type 1 | 31.75 | 31.75 | 12.7 | 19.05 |
| Type 2 | 38.1 | 38.1 | 19.05 | 19.05 |
| Type 3 | 38.1 | 38.1 | 12.7 | 25.4 |
| Type 4 | 44.45 | 44.45 | 25.4 | 19.05 |

Figure 12:
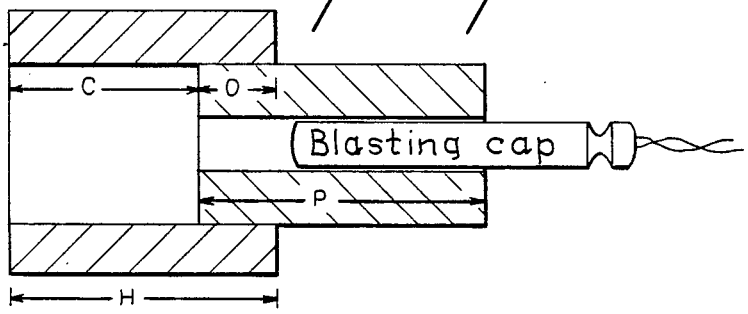
FIG. 12 is similar to FIG. 1 but showing reference lengths H, P, O and C, to be used in conjunction with Table 1 in the Examples.

Each type was attached to a seven strand cable 19 mm in diameter using blasting wire, and a blasting cap was inserted into each device positioned as shown in FIG. 12. The explosive devices were then detonated.

In the case of Type 1 explosive devices, all seven strands were severed in 50% of the experiments.

In the case of Type 2 explosive devices, all seven strands were severed in 80% of the experiments.

In the case of Type 3 explosive devices, all seven strands were severed in 70% of the experiments.

In the case of Type 4 explosive devices, all seven strands were severed in 100% of the experiments.

In all of the experiments, at least five strands of the cable were severed.

EXAMPLE 2

Type 1 explosive devices, as used in Example 1, were prepared and placed in a nylon holder which was adapted to grip the cable and hold the explosive device in close contact with the "open" end of the Detaprime H portion of the device, as shown in FIG. 5. In all experiments, all seven strands of the cable were severed.

I claim:

1. An explosive device comprising a mass of explosive having an indentation upon a surface thereof, said indentation being in the form of a cavity in said explosive, said cavity having a mouth at said surface and said cavity being substantially symmetrical about an axis perpendicular to said mouth, the cross-sectional area of said mouth being about the same as or greater than any other cross-sectional area about said axis within said cavity, said mouth being surrounded by the explosive such that explosive surrounding the mouth has a thickness greater than the critical diameter of said explosive.

2. An explosive device according to claim 1 having means adapted to accomodate a blasting cap at a position distal to said mouth.

3. An explosive according to claim 1 wherein the shape of the cavity is selected from the group consisting of a right cone, a truncated right cone, a right cylinder, a hemisphere and a hemi-oblate spheroid.

4. An explosive according to claim 2 wherein the shape of the cavity is selected from the group consisting of a right cone, a truncated right cone, a right cylinder, a hemisphere and a hemi-oblate spheroid.

5. An explosive device in the form of a kit of parts, said kit comprising:

(a) a cavity shaping device, having a mouth and being substantially symmetrical about an axis perpendicular to said mouth, the cross-sectional area of said mouth being about the same as or greater than any other cross-sectional area about said axis within said cavity shaping device; and (b) a mass of explosive adapted to fit over said cavity shaping device in a manner such that the cavity shaping device delineates an indentation in one face of said mass of explosive, there being sufficient explosive at least to surround said mouth with explosive having a thickness greater than the critical diameter of said explosive, and to provide sufficient explosive distal to said mouth to permit insertion of a blasting cap therein.

6. An explosive device according to claim 5 wherein said explosive is a plastic explosive.

7. An explosive device according to claim 6 wherein said explosive is selected from water gel and emulsion explosives.

8. A method for explosively affecting a substrate comprising placing the explosive device of claim 1 in contact with the substrate, with the mouth of the cavity being substantially in direct contact with said substrate, and detonating said explosive, initiating the detonation from a position distal to said mouth.

9. A method according to claim 8 wherein said substrate is an elongate article and said mouth of the cavity of said explosive device has an internal diameter at least as great as the width of said elongate article.

10. A method according to claim 8 wherein said substrate is a block of rock having a borehole drilled therein, wherein said mouth of the cavity of said explosive device is in contact with the rock at the internal end of said borehole.

11. A method according to claim 8 wherein said substrate is a block of rock and said explosive device is placed directly on the rock.

12. A method according to claim 8 wherein said substrate is the surface of the earth.

13. A secondary blasting method comprising (a) placing a cavity shaping device on a block of rock, said cavity shaping device having a mouth substantially symmetrical about an axis perpendicular to said mouth, the cross-sectional area of said mouth being about the same as or greater than any other cross-sectional area about said axis, said placement being such that the mouth of said cavity shaping device is in contact with the rock, (b) surrounding said cavity shaping device with a conformable explosive, (c) inserting a blasting initiator into said explosive at a position distal to said cavity shaping device; and (d) detonating said explosive with the blasting initiator.

14. A secondary blasting method according to claim 13 wherein the conformable explosive is a cap-sensitive water-gel or emulsion explosive.

* * * * *